United States Patent [19]

Edwards

[11] 4,275,895

[45] Jun. 30, 1981

[54] ROLLER SKATE BRAKE

[76] Inventor: Jesse O. Edwards, 2927 W. Camile, Santa Ana, Calif. 92704

[21] Appl. No.: 115,103

[22] Filed: Jan. 24, 1980

[51] Int. Cl.[3] ..... A63C 17/14

[52] U.S. Cl. ..... 280/11.2; 188/29

[58] Field of Search ..... 280/11.2; 188/29

[56] References Cited

U.S. PATENT DOCUMENTS

| | | | |
|---|---|---|---|
| 2,179,592 | 11/1939 | Goettie | 280/11.2 |
| 3,767,220 | 10/1973 | Peterson | 280/11.2 |
| 4,003,582 | 1/1977 | Maurer | 280/11.2 |
| 4,076,266 | 2/1978 | Krausz | 280/11.2 |

*Primary Examiner*—Robert R. Song

*Attorney, Agent, or Firm*—Fischer and Tachner

[57] ABSTRACT

An improved roller skate braking apparatus for applying frictional braking action to the rear wheels of modern roller skates. Insertable brake linings are held in a brakeshoe that is forced against the rear surface of the rear roller skate wheels by means of fulcrum action when the roller skater applies rearward pressure against an elongated C-shaped applicator that is adjacent to the lower portion of the skater's calf area and that is connected to the remaining brake mechanism by a lever. Upon release of the rearward force by the roller skater on the braking applicator when braking is no longer desired, springs, compressed during braking, extend back to their nominal length forcing the brake shoe and linings away from the rear wheels to automatically terminate the braking action.

6 Claims, 7 Drawing Figures

ROLLER SKATE BRAKE

BACKGROUND OF THE INVENTION

1. Field of the Invention

This invention relates to brakes for roller skates, and more particularly to an improved device for use in combination with roller skates for applying braking action to the rear wheels thereof.

Although roller skating has been a well-known source of recreational enjoyment since at least the 19th century, improvements in materials useful for roller skate wheels and trucks have resulted in a surprising resurgence in the popularity of roller skates, particularly those that are designed to include wheels of modern resilient material that increase the comfort and the durability of the skates.

Although various prior art devices for applying braking action to roller skates have been disclosed, none known to applicant is compatible with the new, radically different structure of modern roller skates. As a result, modern skates depend for their braking action on a large rubber braking pad, typically of truncated conical configuration, that is located in the forward-most portion of the skate structure whereby braking action is caused to occur when the roller skater's foot is bent forward at the ankle to cause the braking device to come into contact with the floor surface. Because of the forward location of such conventional braking devices, it is unsafe to apply such braking action with the roller skater facing the direction of his motion. Clearly, the creation of a rotational moment around the braking portion of the skates would cause the skater to tumble forward over his skates and perhaps incur injuries. Consequently, typical braking action used in such conventional brake pads on modern skates, is applied after the roller skater rotates his body 180° so that he is facing opposite the direction of his travel. Although such reversal of facing direction precludes the tumbling result referred to above, it requires that the roller skater risk not seeing obstacles in the direction of his path and therefore creates a second danger that may also result in collisions and substantial injuries.

Prior art patents relating to devices to provide skate wheel braking action, include by way of example, U.S. Pat. No. 862,849 to Rumble which discloses the use of a brake shoe which is forced into contact with the front side of the skates' rear wheels by means of a lever in response to forward knee action imparted by the skater against brake levers which are secured to the skater's legs by straps. Braking action in the Rumble device occurs when the brake levers are pivoted forward or, in other words, when the skater's feet are rotated up towards the knees of the skater. This, of course, will be recognized by those familiar with the roller skate art as an unnatural motion for braking that is opposite the direction for braking using the conventional forward located braking devices referred to above.

In U.S. Pat. No. 1,402,010 to Ormiston a roller skate brake is disclosed in which rearward motion of an ankle brace, including side members, causes pivoting of a brake shoe to come into contact with a disk portion of a roller skate tire in this ancient two-wheel roller skate.

In U.S. Pat. No. 1,445,048 to Spross, rotation of the foot that brings the toes up towards the kneecaps, causes a brake band to bend and come into contact with the roller skate wheel tire to cause braking action.

Still another U.S. Pat. No. 2,027,487 to Means, discloses a brakeshoe that comes into contact with the rear surface of the skate wheels when forward pressure is applied to a lever by an operating link connected by a cord which, presumably, is held by the roller skater in his hands and pulled upwardly when braking is desired.

In all such prior art patents relating to the roller skate brake art, the devices disclosed therein are not compatible with the modern skate and the modern roller skater either because such prior art devices require the use of some form of strapping engagement with the leg of the roller skater which would substantially hinder his freedom of motion and become a general annoyance, or because they teach the use of an extention, such as a rope or strap, or such as one that surrounds the waist of the roller skater or that must be held in the hands of the roller skater and which also hinders freedom of motion and constitutes a general annoyance that inhibits the liklihood of commercial success and marketability of such skate brake devices.

SUMMARY OF THE INVENTION

The present invention employs a number of novel features that render it highly advantageous over the aforementioned prior art roller skate brakes. The invention includes a brake applicator device that is designed to come into contact with the rear portion of the lower calf of the user's leg without requiring a strap or other such fastening means to engage the skater's leg. The present invention thus avoids the highly disadvantageous freedom-inhibiting actuating devices of prior art brakes. In addition, the present invention utilizes unique replaceable brakeshoe linings that enable the worn portion of the brake to be replaced periodically without a substantial additional expenditure for replacement of a major portion of the brake mechanism. Such replaceable brake linings permit the use of a variety of different geometries that render the present invention compatible with a variety of different modern roller skate wheel configurations. Still another unique and advantageous feature of the present invention, not found in the prior art, is the use of compression springs which automatically release the braking action when rearward calf pressure is released by rotating the skater's legs relative to his feet to a more straight-up configuration typical of the nominal skating position.

OBJECTS

It is therefore a principal object of the present invention to provide an improved roller skate brake which substantially overcomes, or entirely eliminates, the incompatibility of such prior art devices with modern roller skates.

It is an additional object of the present invention to provide a roller skate brake mechanism which obviates the need for any form of surrounding engagement with the leg of the skater that would otherwise inhibit freedom of motion and cause general annoyance to the skater.

It is still an additional object of the present invention to provide a roller skate brake apparatus for applying frictional braking action to the rear wheels of modern skates by means of insertable brake linings which may be selected from a variety of geometrical configurations to provide compatibility with a plurality of different skate wheel dimensions.

It is still a further object of the present invention to provide an improved roller skate brake apparatus in which braking action is automatically disengaged when the roller skater assumes an accelerating position and braking action is undesired.

The above-indicated advantages and objects of the present invention, as well as additional objects and advantages, will be more fully understood hereinafter as a result of the detailed description of a preferred embodiment of the invention, taken in conjunction with the following drawings in which:

DETAILED DESCRIPTION OF A PREFERRED EMBODIMENT

Figure 1:
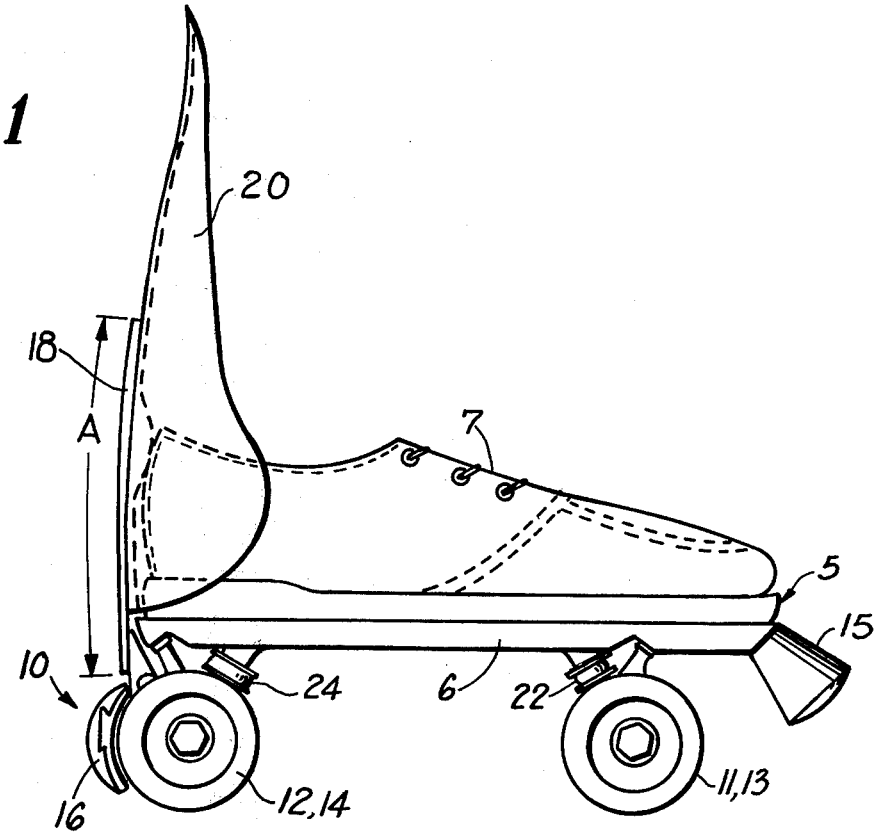
FIG. 1 is a side view of a modern roller skate in which an embodiment of the present invention is installed therein.
Figure 2:
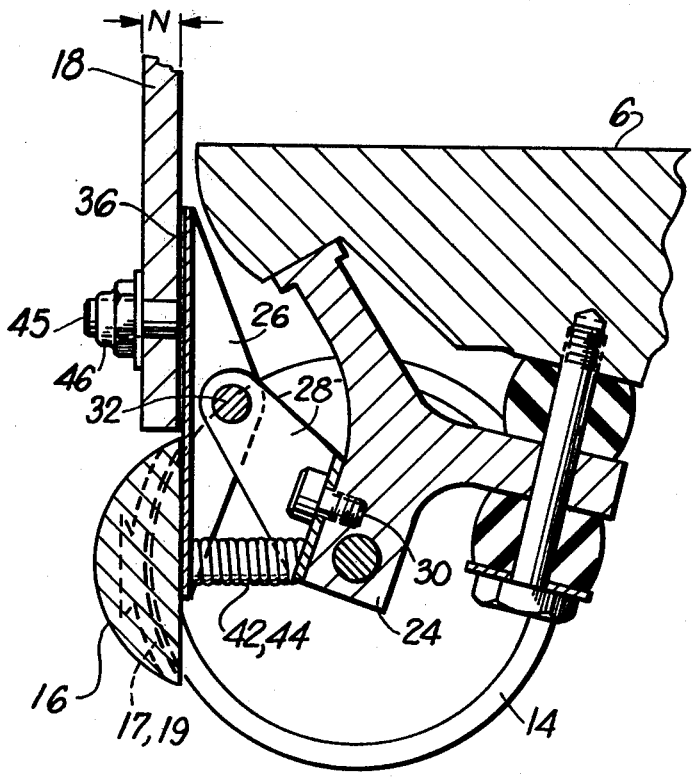
FIG. 2 is an enlarged sectional view of the braking mechanism of the present invention taken along lines 2—2 of FIG. 3 to facilitate a detailed description of the various components of one embodiment thereof.
Figure 3:
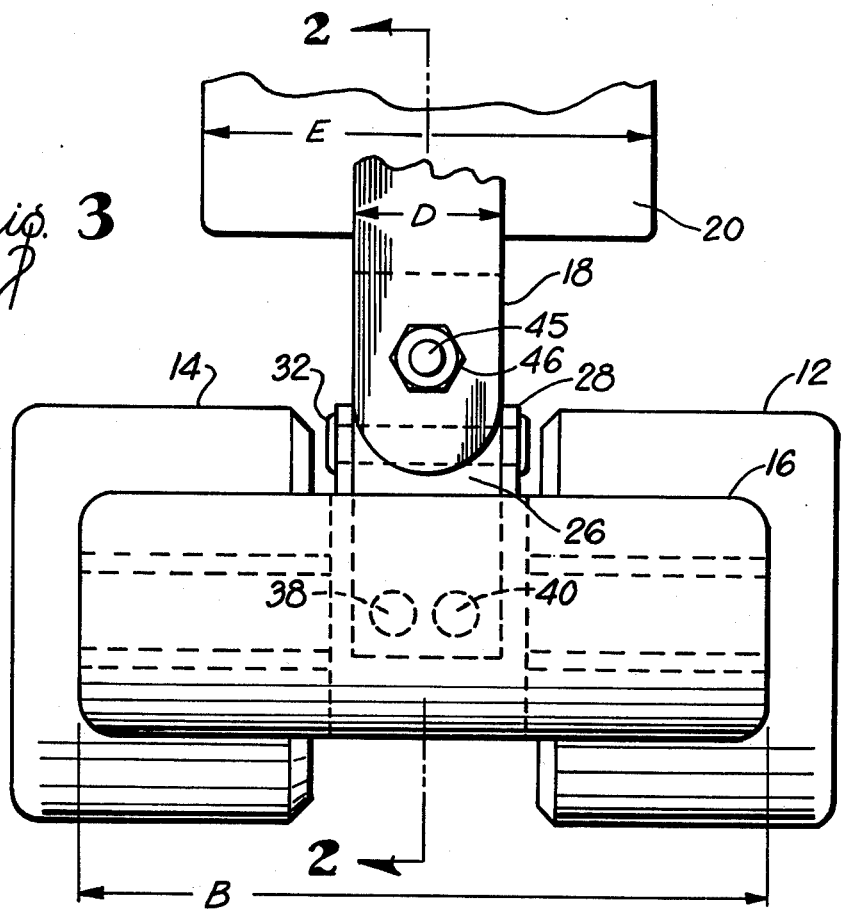
FIG. 3 is an enlarged view of the rear wheels of the roller skate and skate brake combination of the embodiment illustrated in FIG. 1.
Figure 4:
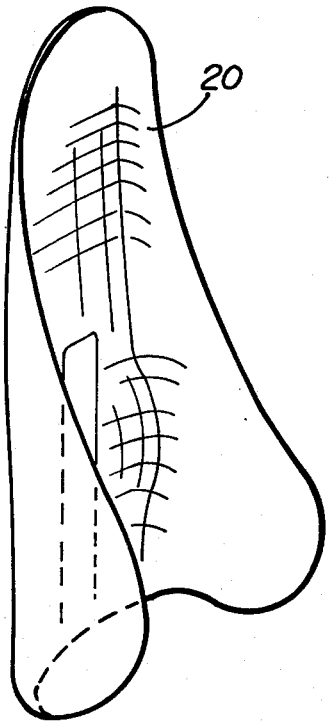
FIG. 4 is a three dimensional drawing of the brake applicator portion of the present invention.
Figure 5:
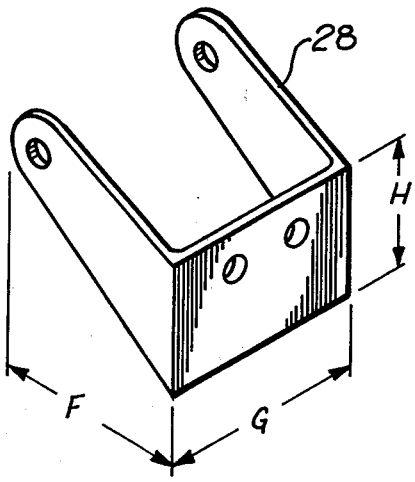
FIGS. 5, 6 and 7 are drawings of additional component portions of the invention.
Figure 6:
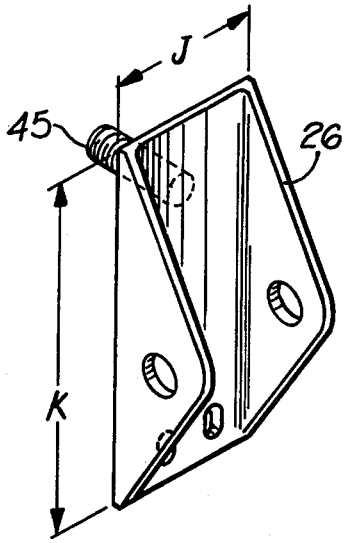
Figure 7:
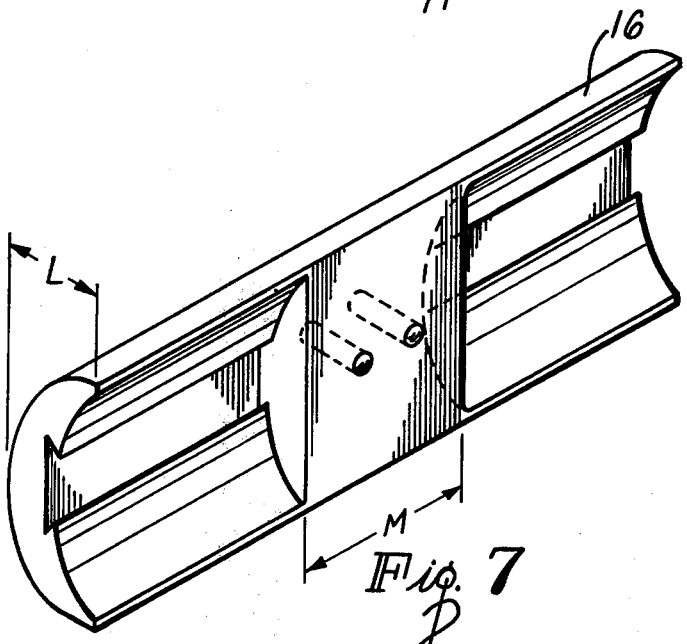

Referring now to FIG. 1 there is shown therein a skate 5 of modern conventional configuration but with the addition of applicant's invention in the form of skate brake 10 for applying friction to the rear portion of the rear wheels. Roller skate 5 includes a shoe 7 which may be any one of a number of virtually unlimited shoe types and sizes for both adults and children and for both male and female roller skaters. Shoe 7 is secured to a support bar 6 by conventional means. Support bar 6 is, in turn, secured to a pair of trucks, namely, forward and rear trucks 22 and 24, respectively, which provide means for attaching conventional wheels including front wheels 11 and 13 and rear wheels 12 and 14.

For purposes of illustrating the prior art braking means used with modern roller skates, conventional forward brake pad or toe stop 15 is also shown in FIG. 1. However, it is contemplated that when the present invention is employed as the braking means for modern roller skates as hereinafter taught by applicant, the use of forward brake pad 15 would be obviated. Thus, it is contemplated that in its typical configuration, the sole means for braking the roller skates would be the present invention which is generally referrred to hereinafter as brake 10 of which a complete description now follows in conjunction with FIGS. 1-7.

As shown in the FIGS. 1-7, brake 10 comprises a brake applicator 20 which is connected in partial rotational engagement to the remaining components of skate brake 10 by means of a lever arm 18 as shown best in FIG. 1. Brake applicator 20 is an elongated C-shaped member that is adapted to partially surround the rear portion of shoe 7 of roller skate 5 and extends up adjacent the calf portion of the skater's leg. Rearward directed pressure applied by the skater against the applicator by means of rotating the ankle joints to move the foot in a direction away from kneecaps, results in friction engagement of brake components with the rear portion of the rear wheels as will be more fully understood hereinafter.

The aforementioned frictional engagement occurs when brake shoe 16 is forced against the rear wheels. The lower portion of lever 18 is connected to the top portion of a brake shoe bracket 26 shown best in FIG. 2. Brake shoe 16 is attached to the lower portion of brake shoe bracket 26 whereby rearward motion of the applicator 20 and lever 18 produces forward motion of brake shoe 16 relative to the rear wheels of the skate to produce the braking action.

Brake shoe bracket 26 is rotationally connected to a pivot mounting bracket 28 by means of a bracket pin 32. Pivot mounting bracket 28 is, in turn, connected to rear wheel truck 24 by means of truck mounting bolts 30. It will be understood that both front wheel truck 22 and rear wheel truck 24 need not be of any special configuration for installation of the present invention and that by merely drilling appropriate bolt holes that are then threaded through the back portion of rear wheel truck 24, the components of the present invention may be installed on virtually any commonly available roller skate of modern design. Brackets 26 and 28, which are secured to one another by means of bracket pin 32, are retained in that relative relationship by means of a pair of standard retainer rings.

Brake shoe 16 is secured to bracket 26 by means of a pair of brake shoe bolts 38 and 40, the heads of which lie along the inside surface of bracket 26 and form guide posts for a pair of compression springs 42 and 44 are designed to automatically release the braking action of the present invention when the roller skater ceases application of rearward pressure to the applicator 20 and lever 18. Lever 18 is secured to bracket 26 by means of an elastic stop nut 46 which is threaded onto a threaded bolt 25 that is welded to or otherwise made captive to bracket 26. An adhesive backed TEFLON tape 36 is preferrably placed between bracket 26 and lever 18 to permit articulation therebetween without galling the metal of either.

It is generally well known that the geometrical configuration of wheels of modern roller skates may differ to some extent in radius and width depending upon the roller skate manufacturer. Accordingly, the present invention is adapted to utilize brake linings 17 and 19 which are installed into brake shoe 16 by means of a dove tail arrangement as shown best in FIG. 2. Each such pair of linings 17 and 19, is selectable from a variety of linings of different radii depending upon the geometrical configuration of the rear wheels with which the present invention may be adapted to operate. Brake linings 17 and 19 may be manufactured by means of extruding molded low friction thermal plastic material such as DELRIN AF and DELRIN 500 and various blends of DELRIN AF and DELRIN 500, which are manufactured by Dupont Corporation, and molded parts of which may be obtained from a number of manufacturers including by way of example, California Injection Molding Company of Costa Mesa, California.

For purposes of further describing the specific details of a preferred embodiment of the present invention, the following Table, taken in conjunction with FIGS. 1-7, indicates various selected dimensions of the components comprising the present invention.

TABLE I

| REF. DESIGNATION | TYPICAL DIMENSION (INCHES) |
|---|---|
| A | 6.75 |
| B | 4.5 |
| C | 1.6 |

TABLE I-continued

| REF. DESIGNATION | TYPICAL DIMENSION (INCHES) |
|---|---|
| D | 1.0 |
| E | 3.5 |
| F | 0.9 |
| G | 1.2 |
| H | 0.9 |
| I | 0.3 |
| J | 1.0 |
| K | 2.6 |
| L | 0.5 |
| M | 1.3 |
| N | 0.3 |

In operation the present invention is used to apply braking friction to the rear portion of the rear wheels of conventional modern roller skates. When the roller skater assumes the usual braking position, namely, rotation of the leg portions below his knees rearwardly with respect to his feet, the calf portion of the leg applies rearward directed force to the braking applicator 20 and lever 18. Fulcrum action about the pivot point comprising bracket pin 32 forces the brake shoe 16 and brake linings 17 and 19 into frictional engagement with rear wheels 12 and 14 with compression of springs 42 and 44 against the rear portion of rear wheel truck 24. Upon release of such rearward force by the roller skater when braking action is no longer desired, springs 42 and 44 extend back to their nominal length and thus act automatically to force the brake shoe and linings away from the rear wheels and which results in cessation of the braking action.

It will now be understood that what has been disclosed is an improved roller skate brake for applying frictional braking action to the rear wheels of modern skates by means of insertable brake linings which may be selected in a variety of geometrical configurations to provide compatibility with a plurality of different skate-wheel dimensions. In addition, it will be clear that what has been disclosed herein is a rear wheel braking roller skate mechanism which, unlike prior art devices, obviates the need for providing means surrounding the leg of the skater that otherwise inhibits the skater's freedom of motion. In addition, the present invention constitutes an improved roller skate brake apparatus in which braking action is automatically terminated as a result of the roller skater assuming a nominal accelerating position when braking action is no longer desired.

Although a preferred embodiment of the present invention has been disclosed herein, it will now be understood by those skilled in the art to which the present invention pertains, that various structural modifications, material substitutions, and other variations from the teachings disclosed herein may be made without departing from the scope of the present invention which is limited only by the appended claims in which:

I claim:

1. A roller skate brake apparatus adapted for attachment to the rear wheel truck of a roller skate for selectively applying frictional force to the surface of the rear wheels when a roller skater rotates his calf rearwardly to increase the angle between his leg and foot; the apparatus comprising:

a brake applicator adapted for location in close proximity to a roller skater's calf, an elongated lever arm connected at its upper end to said brake applicator, a fulcrum bracket partially rotatable about an axis of rotation that is parallel to the axle of said rear wheels and connected to the lower end of said lever arm, a brake shoe in close proximity to said rear wheels and attached to said fulcrum bracket for rotation relative to said rear wheels about said axis, and means for connecting said fulcrum bracket to said rear wheel truck for rotation of said bracket relative to said truck about said axis.

2. The roller skate brake apparatus defined in claim 1, wherein said brake applicator comprises:

a C-shaped member having an oblong lower portion for substantially circumscribing the heel of a roller skater's foot and also having an elongated upper portion curved to partially overlie a roller skater's calf in spaced substantially parallel relation thereto.

3. The roller skate brake apparatus defined in claim 1, wherein said fulcrum bracket connecting means comprises:

a truck mounting bracket secured to said fulcrum bracket by a pin extending along said axis of rotation, and means for securing said truck mounting bracket in fixed engagement with said rear wheel truck.

4. The roller skate brake apparatus defined in claim 3, wherein said apparatus further comprises:

at least one spring mechanism extending longitudinally between said fulcrum bracket and said truck mounting bracket for imparting relative rotational force therebetween that tends to force said brake shoe away from said rear wheels.

5. The roller skate brake apparatus defined in claim 1, wherein said brake shoe is adapted to slidably receive brake linings and wherein said apparatus further comprises:

brake linings having length and radius of curvature dimensions compatible with said rear wheels and being adapted for removal and replacement in said brake shoe.

6. A roller skate brake apparatus adapted for attachment to the rear wheel truck of a roller skate for selectively applying frictional force to the rear surface of the rear wheels when a roller skater rotates his calf rearwardly to increase the angle between his leg and foot; the apparatus comprising:

a brake applicator adapted for location in close proximity to a roller skater's calf, an elongated lever arm connected at its upper end to said brake applicator, a brake shoe in close proximity to said rear surface of said rear wheels, and fulcrum means connected at first end to the lower end of said lever arm, connected at a second end to said brake shoe, and connected at about the midpoint thereof to said rear wheel truck in relative rotational engagement therewith about an axis that is parallel to the axle of said rear wheels, whereby rearward directed motion of said brake applicator moves said brake shoe into frictional engagement with said rear surface of said rear wheels.

* * * * *